United States Patent [19]

Gregory

[11] Patent Number: 4,765,777

[45] Date of Patent: Aug. 23, 1988

[54] APPARATUS AND METHOD FOR RAISING AND SUPPORTING A BUILDING

[76] Inventor: Steven D. Gregory, 2400 S. Monta Vista, Ada, Okla. 74820

[21] Appl. No.: 68,193

[22] Filed: Jun. 29, 1987

[51] Int. Cl.[4] ..... E02D 5/00

[52] U.S. Cl. ..... 405/230; 254/29 R; 405/229

[58] Field of Search ..... 405/230, 196, 199, 229, 405/232; 254/29 R

[56] References Cited

U.S. PATENT DOCUMENTS

| | | | |
|---|---|---|---|
| Re. 13,532 | 2/1913 | Breuchaud | 405/230 |
| 563,130 | 6/1896 | Breuchaud | 405/230 |
| 776,419 | 11/1904 | Platt . | |
| 957,844 | 5/1910 | Breuchaud | 405/230 |
| 1,181,212 | 5/1916 | Clark . | |
| 1,217,128 | 2/1917 | White | 405/230 |
| 1,296,628 | 3/1919 | Cooney . | |
| 1,705,068 | 3/1929 | Sadtler . | |
| 1,742,423 | 1/1930 | Stern . | |
| 1,827,921 | 10/1931 | White | 405/230 |
| 2,322,855 | 6/1943 | Lenahan . | |
| 2,381,014 | 8/1945 | Thornley . | |
| 2,741,910 | 4/1956 | Thornley . | |
| 2,944,403 | 7/1960 | Smith | 405/199 |
| 2,982,103 | 5/1961 | Revesz et al. | 405/230 |
| 3,396,945 | 8/1968 | Schreier et al. | 405/199 X |
| 3,638,378 | 2/1972 | Russ, Jr. . | |
| 3,796,055 | 3/1974 | Mahony | 405/230 |
| 3,852,970 | 12/1974 | Cassidy | 405/230 |
| 3,861,156 | 1/1975 | Uchida . | |
| 3,902,326 | 9/1975 | Langenbach, Jr. | 405/230 |
| 4,012,917 | 3/1977 | Gendron | 405/199 |
| 4,070,867 | 1/1978 | Cassidy | 405/230 |
| 4,563,110 | 1/1986 | Langenbach, Jr. et al. | 405/230 |
| 4,591,466 | 5/1986 | Murray et al. . | |
| 4,595,062 | 6/1986 | Boyadjieff et al. | 166/77 X |
| 4,634,319 | 1/1987 | May | 405/230 |
| 4,673,315 | 6/1987 | Shaw et al. | 405/230 |

FOREIGN PATENT DOCUMENTS

| | | | |
|---|---|---|---|
| 2022787 | 11/1981 | Fed. Rep. of Germany . | |
| 985351 | 3/1965 | United Kingdom | 405/230 |
| 1418164 | 12/1975 | United Kingdom | 405/230 |

*Primary Examiner*—Dennis L. Taylor
*Attorney, Agent, or Firm*—Warren B. Kice

[57] ABSTRACT

An apparatus and method for raising and supporting the foundation or slab of a building, in which a lifting assembly engages the lower surface of the foundation or slab and is secured thereto. A piling is disposed adjacent the lifting assembly and is engaged by a driving assembly. A hydraulic ram is connected between the driving assembly and the lifting assembly in the expanded position of the ram so that when said ram is retracted, the piling is driven into the ground until it encounters a predetermined resistance. The ram is further actuated after the predetermined resistance is encountered to raise said foundation or slab a predetermined distance.

10 Claims, 3 Drawing Sheets

APPARATUS AND METHOD FOR RAISING AND SUPPORTING A BUILDING

BACKGROUND OF THE INVENTION

This invention relates to an apparatus and method for raising and supporting a building, and more particularly to such an apparatus and method in which pilings are used to support the foundation or concrete slab of a building.

Houses and other buildings are often erected on foundations or concrete slabs which are not in direct contact with load supporting underground strata, such as bedrock, or the like. If not initially constructed properly, or if soil conditions change, the foundation footing may settle, causing the foundation or slab to sag and/or crack. Unless the building is supported, or shored, continued settling may result in major structural damage or collapse of the building.

There have been several suggestions in the prior art for raising and supporting the foundation or slab of a building of this nature. For example, according to one technique the foundation or slab is lifted, or jacked up, and pilings are inserted underneath to support same. However, the pilings are often not directly supported on the bedrock, resulting in continued settling after the pilings are in place. Also, these techniques often require extensive evacuation of the basement flooring for placing the pilings under the foundation walls, which is expensive. Further, in many instances, the pilings are visible above the basement floor.

In still other prior art techniques utilizing pilings, a single hydraulically actuated system is used for each piling, requiring the use of a relatively high pressure hydraulic system, which is expensive and cumbersome to use. Also, if the pilings are lifted individually, the structure of the foundation or slab becomes uneven which causes additional potential problems.

In co-pending, application, Ser. No. 766,775, filed Aug. 16, 1985, now U.S. Pat. No. 4,673,315, of which the present applicant is a co-inventor, these problems with the prior art techniques are overcome in an apparatus that features a hydraulic ram system connected between a clamp secured to the upper portion of the piling and a guide means connected to the lifting arm that extends under the foundation or slab of the building. Upon retraction of the hydraulic ram system, the pipe assembly is driven into the ground until it encounters a predetermined resistance after which the ram assembly is actuated again to raise the foundation or slab a predetermined distance.

As a result, the pilings are supported directly on the bedrock and are invisible after the method is completed, even though only minimum excavation of the ground surrounding the foundation is required. In addition, this system eliminates the need for high pressure ram devices while permitting all of the piling assemblies associated with the particular foundation to be raised at once.

SUMMARY OF THE INVENTION

It is an object of the present invention to provide an apparatus and method which provides still further improvements on the above technology.

It is a further object of the present invention to provide an apparatus and method for supporting and raising a foundation or slab in which pilings are inserted between the lower surface of the foundation or slab and are supported directly on bedrock.

It is still further object of the present invention to provide an apparatus and method of the above type in which the pilings are relatively strong and invisible after the method is completed.

It is a still further object of the present invention to provide an apparatus and method of the above type, which requires minimum evacuation of the ground surrounding the foundation or slab.

It is a still further object of the present invention to provide an apparatus and method of the above type in which a pair of hydraulic systems operate in tandem with each piling assembly.

It is a still further object of the present invention to provide an apparatus of the above type in which all of the piling assemblies associated with the particular foundation or slab are raised at once.

It is a still further object of the present invention to provide an apparatus and method of the above type in which a lifting assembly is provided which is secured directly to the foundation to stabilize the system and provide for a more efficient and precise operation.

Toward the fulfillment of these and other objects, the apparatus of the present invention includes a lifting assembly engaging the lower surface of the foundation or slab and secured to the foundation or slab. A drive unit engages the upper portion of the pilings, and the respective ends of a hydraulic ram unit are connected between the lifting assembly and the drive unit. The ram unit is then retracted to drive the pilings into the ground.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENT

Figure 1:
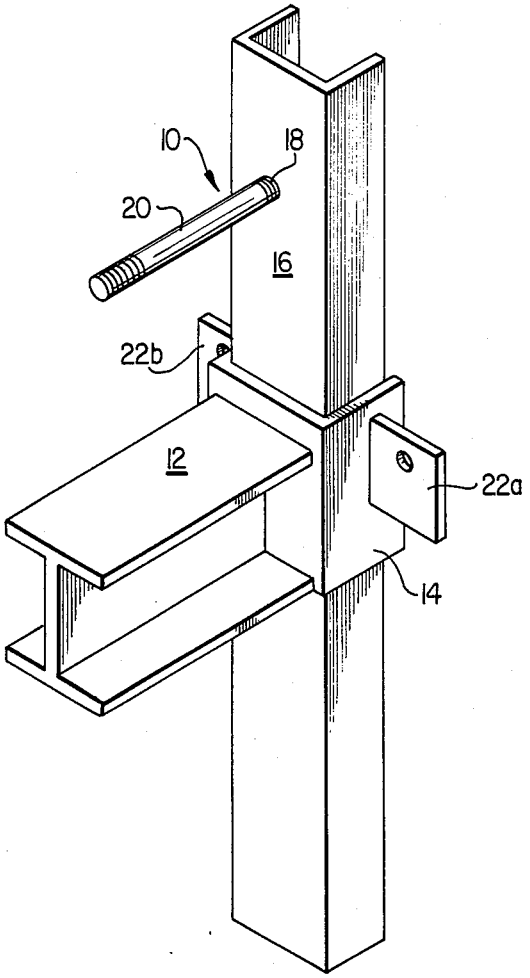
FIG. 1 is a perspective view depicting a lifting assembly forming a portion of the apparatus of the present invention.

Referring specifically to FIG. 1 of the drawings, the reference numeral 10 refers, in general, to a lifting assembly forming a portion of the apparatus of the present invention and including a lifting arm 12, in the form of an I-beam, and a relatively short channel iron 14 welded to one end of the lifting arm 12 and extending perpendicular thereto. A relatively long channel iron 16 is slidably mounted in the channel iron 14 and an opening 18 extends through the base portion of the channel iron 16 for receiving a threaded anchor bolt 20, for reasons to be explained. A pair of mounting plates 22a and 22b are connected, and extend perpendicular, to the leg portions of the channel iron 14 and each has an opening extending therethrough.

Figure 3:
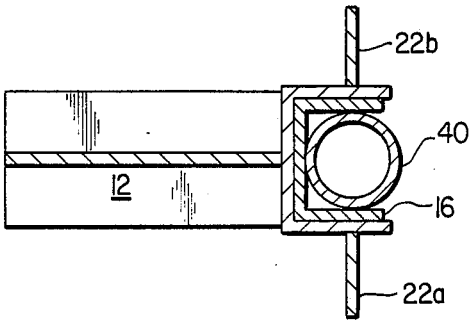
FIG. 3 is a cross-sectional view taken along the line 2—2 of FIG. 2.
Figure 2:
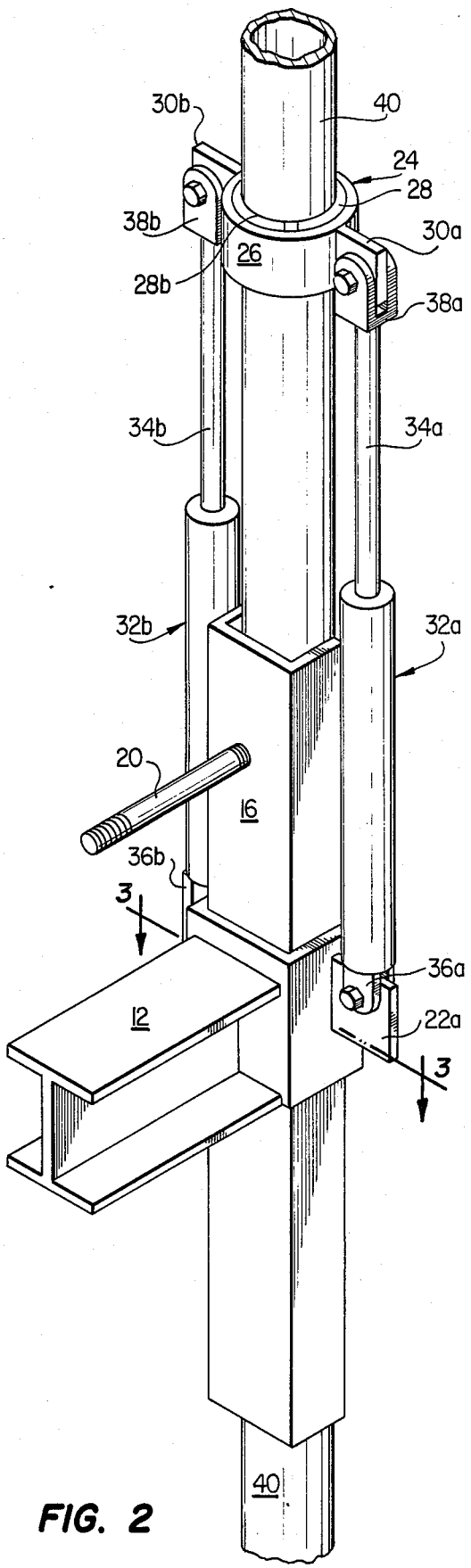
FIG. 2 is a perspective view of the apparatus of the present invention.

FIGS. 2 and 3 depict the lifting assembly 10 connected to the remaining components of the apparatus of the present invention, which components include a driving, or clamping, assembly, shown in general by the reference numeral 24, which is formed by an outer ring 26 and three inner arcuate inserts, two of which are shown by the reference numerals 28a and 28b. These inserts are tapered in a vertical direction so that they will grab, or clamp, a pipe segment of a predetermined diameter during downward movement and slide over the pipe segment during upward movement, in a conventional manner. The clamping assembly 24 is disclosed in more detail in the above-mentioned patent application, the disclosure of which is hereby incorporated by reference.

A pair of mounting plates 30a and 30b are connected to, and extend from, diametrically opposite portions of the ring 26 and each has an opening extending therethrough.

A pair of hydraulic ram units 32a and 32b are provided which are installed between the respective plates 22a and 22b of the channel iron 14, and the plates 30a and 30b of the clamping assembly 24. The ram units 32a and 32b include a pair of arms 34a and 34b, respectively, which are connected to pistons (not shown) which reciprocate in the ram units in response to actuation of the units, in a conventional manner. This reciprocal movement of the pistons causes corresponding movement of the arms 34a and 34b between the extended position shown in FIG. 2 and a retracted position.

A pair of clevises 36a and 36b are connected to the respective ends of the ram units 30a and 30b. The clevises 36a and 36b extend over the plates 22a and 22b and are connected to the latter plates by a pair of bolts. In a similar manner, a pair of clevises 38a and 38b are connected to the end of the arms 34a and 34b, extend over the plates 30a and 30b, and are connected to the latter plates by a pair of bolts.

A piling, or pipe assembly, shown in general by the reference numeral 40 and comprising a plurality of pipe segments, extends through the clamping assembly 24 and within the channel iron 16. Due to the tapered configuration of the arcuate inserts 24a and 24b, the clamping assembly 24 can be manually lifted upwardly on the pipe assembly 40 without encountering substantial resistance. When the hydraulic ram units 32a and 32b are then retracted, the clamping assembly 24 moves downwardly over the pipe assembly and the inserts 24a and 24b grab, or clamp, the outer surface of the pipe assembly and force it downwardly, as will be described in further detail later.

Figure 6:
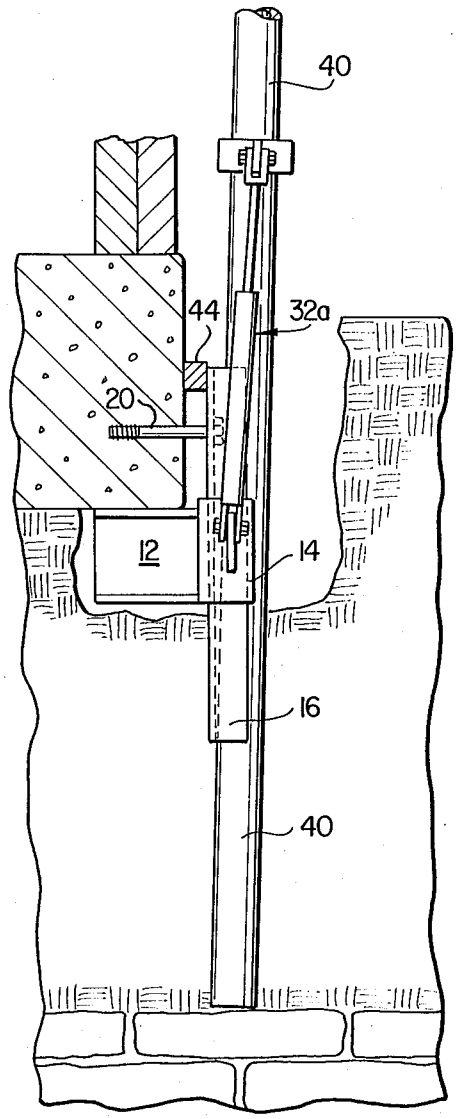
FIGS. 4–6 are elevational views on a reduced scale, showing various stages of installation of the apparatus of FIG. 1 relative to the foundation or slab of a house.
Figure 5:
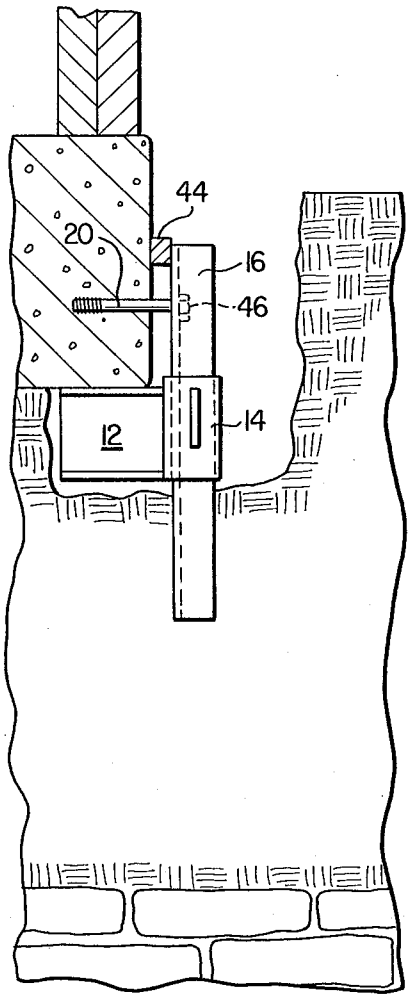
Figure 4:
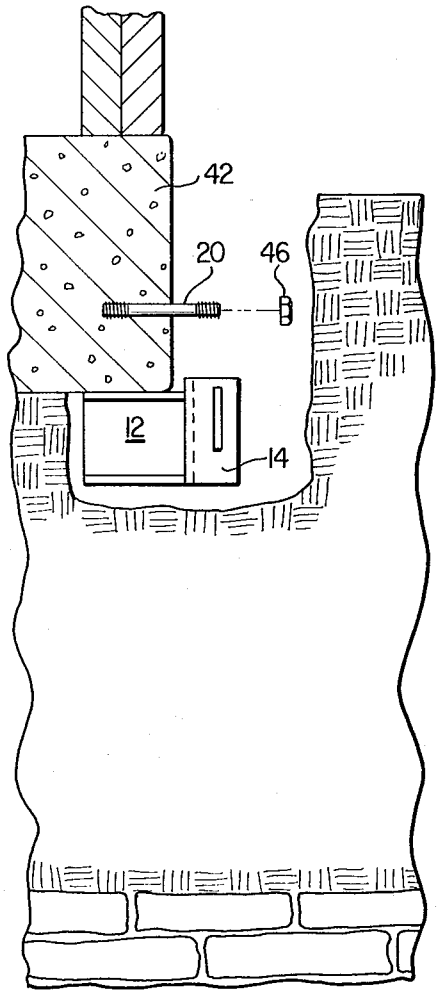

The installation and operation of the apparatus of the present invention will be described with reference to FIGS. 4–6 in connection with a house having a corner foundation 42 that is failing, causing a corresponding sinking of this portion of the house and thus requiring the foundation to be raised, leveled and supported. The area around the corner of the foundation 42 is initially excavated and the lifting assembly 10 is placed in the excavated area with the lifting arm 12 extending underneath the house and against the lower surface of the foundation 42 as shown in FIG. 4. A bore is drilled in the foundation 42 and the anchor bolt 20 is secured in the bore in a conventional manner. The channel iron 16 is inserted through the channel iron 14 and driven into the ground until the channel iron 14 is spaced approximately equally from the ends of the channel iron 16, as shown in FIG. 5, and the bolt 20 aligns with the opening 18 in the channel iron 16. A spacer 44 is placed between the foundation 42 and the channel iron 16 and a nut 45 is then advanced along the threaded exposed end portion of the bolt 20 until the channel iron 16 is secured to the foundation 42.

A section of the pipe assembly 40 is then placed in the channel iron 16 and the clamping assembly 24 is placed over the upper portion of the pipe assembly. The hydraulic ram units 32a and 32b, in their extended positions, are then installed between the respective plates 22a and 22b of the channel iron 14 and the plates 30a and 30b of the clamping assembly 24, as shown in FIG. 6.

The ram units 32a and 32b are then actuated simultaneously to cause a retracting motion of their corresponding pistons, and therefore the arms 34a and 34b, to force the clamping assembly 24 downwardly. As a result, the clamping assembly 24 grabs the pipe assembly 40 and forces it downwardly into the ground for a predetermined distance. The ram units 32a and 32b are then simultaneously actuated back to their expanded condition, moving the clamping assembly 24 upwardly to an upper portion of the pipe assembly 40, and the sequence is repeated. During this sequential driving of the pipe assembly 40 into the ground, additional pipe segments may be added to the assembly 40 as needed.

Although only one apparatus is shown in the drawing it is understood that, in actual practice, several will be used, depending on the extent of the damage. The above procedure is repeated until the lower end portion of each pipe assembly 40 encounters resistance in the ground, which is usually in the form of bedrock or the like, as shown in FIG. 6, in which case the aforementioned driving movement is terminated.

After all of the pipe assemblies 40 have been driven into the ground in the foregoing manner until they encounter resistance, all of the ram units 32a and 32b associated with the pipe assemblies are simultaneously actuated again to raise the foundation 42, and therefore the house, a predetermined distance which can be approximately two to five inches.

After the above raising is completed, that portion of each pipe assembly 40 extending within its corresponding channel iron 16 is welded to the channel iron. The ram units 32a and 32b, along with each clamping assembly 24, are removed from each lifting assembly 10 and the pipe assemblies 40 are then cut at a point immediately above the channel iron 16. The excavated area around each pipe assembly is then filled in to complete the procedure.

A flow diagram for the system of the present invention is disclosed in the above-identified application, and in view of this and in view of the fact that it does not form any part of the present invention, it will not be described herein.

It is apparent from the foregoing that several advantages result from the apparatus of the present invention.

For example, the pilings formed according to the present invention are supported directly on load bearing strata, which adds stability to the supporting system. Also, the pilings are relatively strong and invisible after the method is completed even though only minimum excavation of the ground surrounding the foundation is required.

Further, the system of the present invention eliminates the need for high pressure ram devices, yet permits all of the piling assemblies associated with the particular foundation to be raised at once. Still further, each lifting apparatus is stabilized by virtue of the bolted connection to the foundation, which increases the efficiency and precision of the operation.

It is understood that, although the above example was described in connection with the foundation of a building, the system of the present invention can also be used in an identical manner to raise a concrete slab extending underneath the entire area of a building or a house. In the case of a concrete slab, the lifting assembly 10 is engaged adjacent an outer edge of the slab in a manner similar to that shown in FIG. 4. In the case of damage to, or sinking of, an internal portion of the slab, a hole can be formed through the damaged portion of the slab, the lifting arm 12 can be inserted through the hole, and the channel irons 14 and 16 rotated to extend underneath the slab. Then the lifting assembly 10 can be raised and the portion of the slab supported in the manner discussed above.

Figure 7:
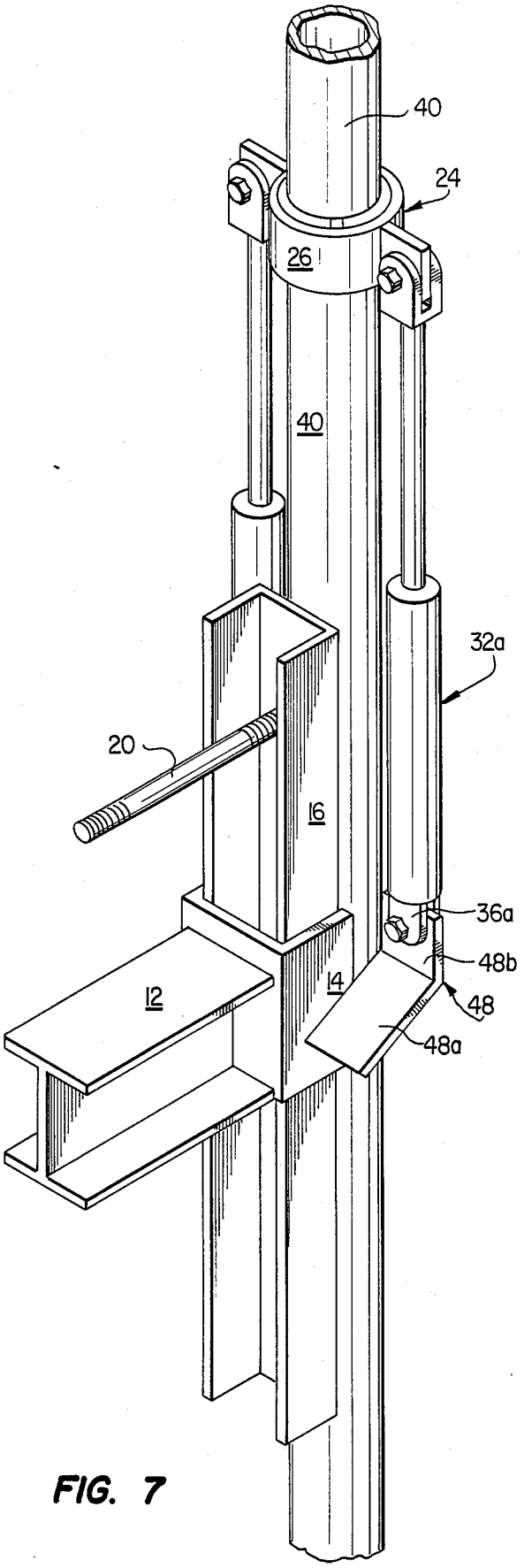
FIG. 7 is a view similar to FIG. 1 but depicting an alternate embodiment of the apparatus of the present invention.

FIG. 7 depicts an alternate embodiment of the apparatus of FIG. 2 and includes components that are identical to those of FIG. 2, which components are given the same reference numerals. According to the embodiment of FIG. 6 the channel iron 16 is reversed, or rotated 180 degrees, from the position shown in FIG. 2 and the pipe assembly 40 thus is disposed immediately adjacent to, or even in engagement with, the base portion of the channel iron 16. An ear 48 is provided which has a vertically extending portion **48*a* connected to the clevis 36*a* of the ram unit 32*a* in the manner described above, and an angularly extending portion 48*b* which is welded, or otherwise attached, to the channel iron 14 of the lifting assembly 10. It is understood that another ear identical to the ear 48 is provided on its other leg of the channel iron 14. Otherwise the arrangement of FIG. 7 is identical to that of FIG. 2**.

It is understood that several other modifications of the apparatus and method of the present invention can be made within the scope of the invention. For example, the clamping assembly can be replaced with a block, or driving member that engages the upper end of the pipe assembly 40 and, when forced downwardly by the ram units **32*a* and 32*b*, drives the assembly into the ground. Also, an external drive system can be provided to drive the pipe assembly 40 into the ground until a predetermined resistance is encountered, after which the ram units 32*a* and 30*b*** can be installed and activated to raise the foundation or slab in the manner described above.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention therein.

What is claimed is:

1. An apparatus for raising and/or supporting the foundation or slab of a building, said apparatus comprising lifting arm means for engaging the lower surface of said foundation or slab, a retaining member engaging said lifting arm means and engaging the outer wall of said foundation or slab, means for securing said retaining member to said foundation or slab, pipe means extending adjacent said retaining member, driving means engaging said upper portion of said pipe means, ram means connected between said driving means and said lifting arm means, and means for actuating said ram means to drive said pipe means into the ground until said pipe means encounters a predetermined resistance, said actuating means adapted to further actuate said ram means after said predetermined resistance is encountered to raise and/or stabilize said foundation or slab, said retaining member maintaining said lifting arm means in engagement with said lower surface during said actuation of said ram means.

2. The apparatus of claim 1 wherein said lifting arm means comprises an arm member and a first channel member secured to said arm member.

3. The apparatus of claim 2 wherein said retaining member is in the form of a second channel member slidably mounted in said first channel member.

4. The apparatus of claim 3 wherein said pipe means extends within said second channel member.

5. The apparatus of claim 3 wherein said pipe means is welded to said second channel member in the raised position of said foundation or slab.

6. The apparatus of claim 1 wherein said ram means is normally in an expanded position, and wherein said actuating means retracts said ram means to drive said pipe means.

7. The apparatus of claim 1 wherein said ram means comprises two ram assemblies extending on opposite sides of said pipe means.

8. The apparatus of claim 7 further comprises two mounting plates extending on opposite side of said lifting arm means for respectively receiving said ram assemblies.

9. The apparatus of claim 7 wherein said engaging means comprises a clamping member extending around said upper pipe portion, and two mounting plates extending on opposite sides of said clamping member for respectively receiving said ram assemblies.

10. The apparatus of claim 9 wherein said clamping member is adapted to clamp said pipe means upon downward movement relative thereto and to disengage said pipe means upon upward movement relative thereto.

* * * * *